United States Patent [19]

Hirsch

[11] 4,095,843

[45] Jun. 20, 1978

[54] HEIGHT ADJUSTMENT APPARATUS FOR CHILD SUPPORT

[76] Inventor: James C. Hirsch, 2148 Tanglewood, Highland Park, Ill. 60035

[21] Appl. No.: 764,839

[22] Filed: Feb. 2, 1977

[51] Int. Cl.[2] ..... A47B 39/00

[52] U.S. Cl. ..... 297/136

[58] Field of Search ..... 297/345, 27, 19, 35, 297/135, 136, 137; 248/377, 421, 157; 108/116, 118; 403/109

[56] References Cited

U.S. PATENT DOCUMENTS

| | | | |
|---|---|---|---|
| 1,030,938 | 7/1912 | Stamps | 248/165 X |
| 1,300,412 | 4/1919 | Jones | 403/109 X |
| 2,106,309 | 1/1938 | Sweeney | 108/116 |
| 2,432,192 | 12/1947 | Gaudette | 108/116 |
| 2,471,564 | 5/1949 | Gaudette | 108/118 |
| 2,540,291 | 2/1951 | Reingold | 297/136 X |
| 2,587,176 | 2/1952 | Larson | 297/31 |
| 2,683,482 | 7/1954 | Puls | 297/136 |
| 3,155,426 | 11/1964 | Rockwell | 297/136 |

*Primary Examiner*—James T. McCall

[57] ABSTRACT

The following specification describes a baby feeding table or high chair raised to a feeding position or lowered to a play position by changing the angle between one pair of parallel tubular legs pivotally connected to another pair of parallel tubular legs intermediate their ends. The one pair of parallel legs are pivotally secured to the table top at positions spaced intermediate the baby's chair and the table edge and the other pair of parallel legs are pivotally supported from the table top by a U-shaped lever bar, which is pivotally connected with both the other pair of legs and the table top at positions spaced intermediate the chair and the table edge.

A cross bar extends between the legs and has ends overlappingly engaged with one pair of legs coincident with the pivot connection to other pair of legs for stabilizing the legs. Washers in the cross bar secure the pivot pins between the legs. The bar also carries a pivotable U-shaped latch rod for engaging the lever bar to secure the table in the feeding position.

Thrust washers located between the legs at the respective pivots distribute the forces and stabilize the connections.

The legs are formed of separable upper and lower sections for facile packing and shipping. The sections include plastic stabilizing rings for reinforcing the assembly sections, which are secured to each other by a spring biased pin in one section engaging a hole in the mating section. Casters are provided on selected lower leg sections for rolling support of the table.

11 Claims, 8 Drawing Figures

HEIGHT ADJUSTMENT APPARATUS FOR CHILD SUPPORT

BACKGROUND OF THE INVENTION

1. Field of the Invention

This invention relates in general to baby feeding tables and more particularly to an improved, economical and more versatile support arrangement for a baby feeding table or a high chair.

2. Summary of the Prior Art

Baby feeding tables have a chair or seat foldably suspended from the center of the table top and are usually provided with leg adjustment apparatus to permit the table top to be raised or lowered as suits the baby's mother. Raising the table top generally enables the mother to more conveniently feed the child and this position is commonly known as the feeding position. Lowering the table top places the child closer to the floor during play periods, when the child may be unsupervised, to minimize the possibility of injury if the child should crawl over an edge of the table. The latter position of the table is commonly known as the play position.

The leg adjustment apparatus for raising or lowering the table height incorporates telescoping tubular leg sections in vertically extending legs. The telescoping leg sections include a spring biased pin on one leg section, which engages in any one of a plurality of spaced holes in the other or mating section. As may be appreciated this arrangement is extremely difficult to adjust since each pin must be individually disengaged from one hole and readjusted or aligned with another hole when height changes are desired. Each leg must therefore be individually adjusted while the major weight on the legs is usually relieved by removing the child from the chair and/or usually tipping the table towards each side in sequence. This is of course a cumbersome and undesirable arrangement.

In addition the provision of numerous holes in the tubular leg sections and the overlapping tubing lengths required for a satisfactory range of height adjustment is relatively expensive. Further expensive bracing must be provided for the legs since they are usually also required to be folded against the table top for either shipment or storage.

A mechanism for raising and lowering a table while it is erect is shown in U.S. Pat. No. 2,471,564. That mechanism however is connected to the table top adjacent the center of the top and does not either accommodate a suspended center chair or provide the stability and distribution of forces required of a baby feeding table.

In addition the legs used in the just mentioned mechanism engage the floor in a direction extending from the table center toward a respective table corner. In order to provide this configuration the legs must be bent at different angles relative their pivot holes and the bottom length of leg engaged with the floor subjects the leg to a large bending moment and prevents the use of a caster on the leg for facile movement of the table from place to place.

SUMMARY OF THE INVENTION

The present invention proposes the use of a support arrangement for raising or lowering an erect baby feeding table by pivoting one pair of parallel support legs relative another pair of parallel support legs. The legs are pivotally connected with each other intermediate their ends in a general X-shape so that the front legs extend diagonally upwardly toward a respective rear corner of the table where they are pivotally connected to the table at positions intermediate the baby's seat and the perimeter of the table top. The other pair of rear legs extend diagonally upwardly toward a respective front corner of the table for pivotal connection to the side legs of a U-shaped lever bar. The lever bar side legs are also pivotally connected to the table top at respective positions adjacent the front corner of the top and spaced intermediate the table top perimeter and the seat to pivotally support the rear legs from the table top. Thus the seat is suspended between the legs to locate the center of gravity therebetween so that the forces are distributed between the legs and along their longitudinal axis. The height of the table is changed by pivoting the lever bar to reduce the angle between the legs and place the table top in the feeding position or by increasing the angle between the legs, the table top is lowered to the play position.

In the feeding position the pivot connection between the lever bar side legs and each rear support leg is moved toward the table center and when the lever bar side legs are substantially parallel with the rear support legs, the lever bar back leg is located adjacent a cross bar. The cross bar extends between the pivot connections of the support legs. A simple U-shaped wire or rod latch pivotally carried by the cross bar is then faciley engaged with the lever bar to hold the lever bar and prevent the support legs from pivoting from the feeding position to the play position under the weight of the table and child. The cross bar also carries washers for securing the pivot pins between the support legs and the ends of the cross bar overlappingly engage one pair of support legs for reinforcing the same.

When the latch is disengaged, the support legs pivot apart to increase the angle therebetween and place the table in the play position while the pivot connection to the lever bar side legs passes through the lowest point in its arc. A bent end portion on the upper end of the rear support legs then engage the table top and since further movement of the pivot connection to the lever bar side legs must thereafter be in the direction of the top, further movement of the pivot connection between the lever bar and rear legs and between the support legs is prevented.

It will be appreciated of course that the pivot arrangement also permits the legs to be folded into parallel relationship with the table top for facile storage and shipment.

To further facilitate packing and shipment the legs are formed in an upper and lower section with the lower section telescopingly engaging the upper section for assembling the legs after shipment. The upper sections thus fold against the table top within the perimeter of the top to form a relatively small package. A plastic coupling ring or collar is provided on one of the telescoping or mating sections to reinforce or stabilize the assembled upper and lower sections, which are secured together by a spring biased pin on one section engaging a hold in the other section.

The lower sections also have free end portions which extend transversly to the floor to permit the attachment of casters to the legs and for facilitating the transmission of forces along the longitudinal axis of the legs.

It is therefore among the primary objects of the present invention to provide an improved, economical and more versatile baby feeding table or high chair.

It is another object of the present invention to provide an improved height adjustment arrangement for a baby feeding table.

It is yet another object of the present invention to provide an economical baby feeding table capable of facile height adjustment.

It is still another object of the present invention to provide a stable and reliable baby feeding table capable of facile height adjustment.

Other objects and features of the present invention will become apparent on examination of the following specification and claims together with the accompanying drawings.

DESCRIPTION OF THE PREFERRED EMBODIMENT

Figure 1:
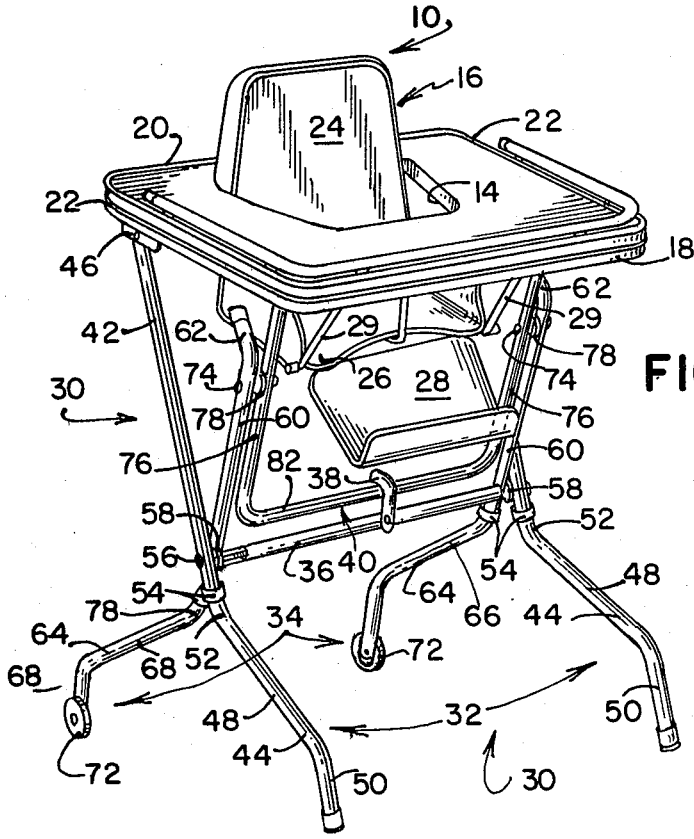
FIG. 1 is a perspective view illustrating a baby feeding table incorporating the principles of the present invention and shown in feeding position.
Figure 2:
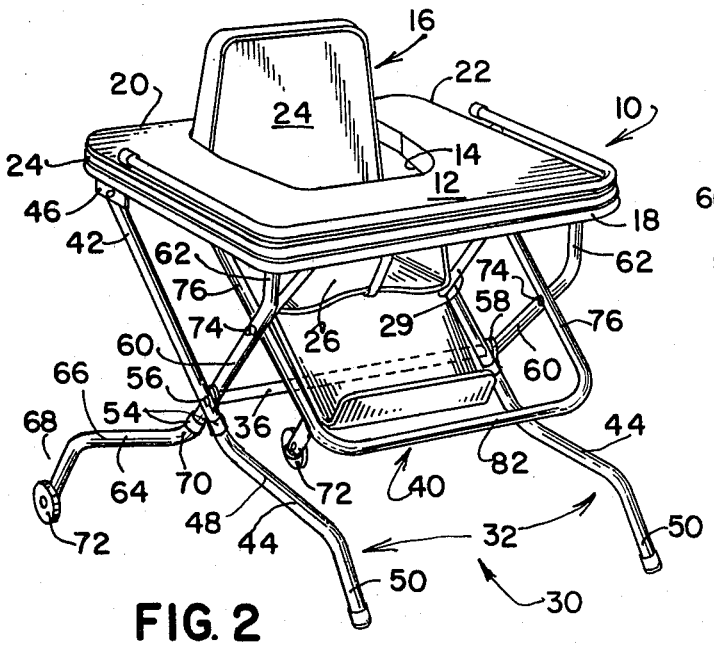
FIG. 2 is a perspective view of the baby feeding table illustrated in FIG. 1 and shown in the play position.
Figure 3:
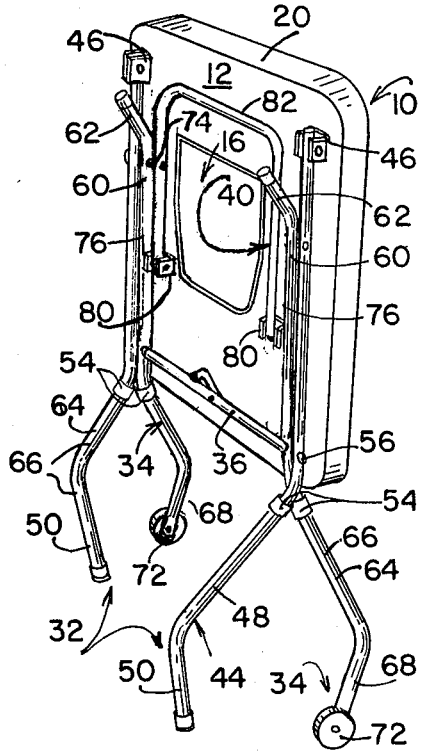
FIG. 3 is a perspective view of the baby feeding table illustrated in FIGS. 1 and 2 shown in folded position for storage.
Figure 4:
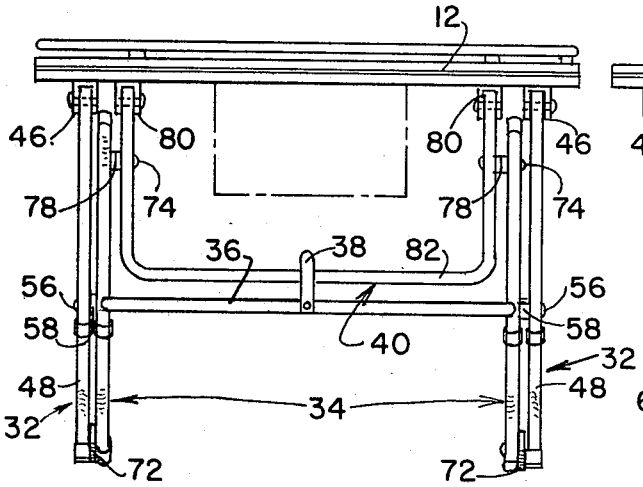
FIG. 4 is a front elevational view of the baby feeding table shown in the feeding position as illustrated in FIG. 1 with the chair indicated only diagramatically.
Figure 5:
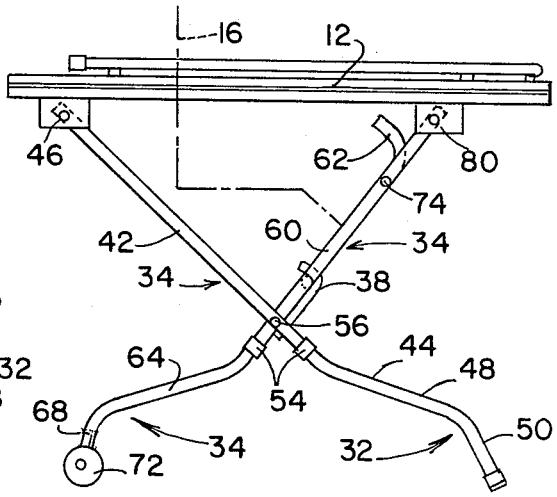
FIG. 5 is a side elevational view of the baby feeding table shown in FIG. 4 with the chair indicated only diagramatically.
Figure 6:
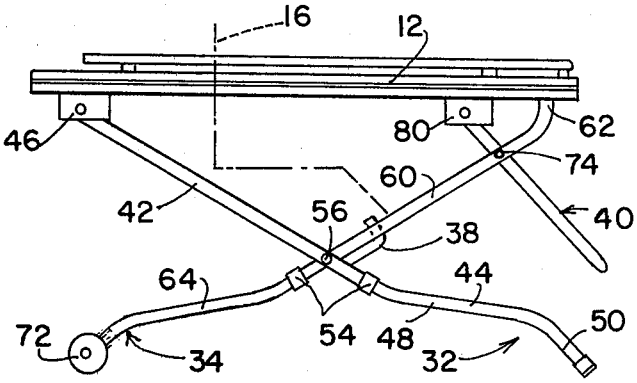
FIG. 6 is a side elevational view of the table shown in the play position as illustrated in FIG. 2 with the chair indicated only diagramatically.

In FIGS. 1–3 a baby feeding table incorporating the principles of the present invention is indicated by the reference character 10. The table 10 includes a table top 12 having an opening 14 in which a conventional foldable seat or chair 16 is suspended. It will be understood that the term baby feeding table includes high chairs and/or other apparatus for supporting a child. The boundary planes of the opening 14 and the chair 16 are located within or spaced intermediate the boundary planes or perimeter of the top 12, which is defined by front and rear edge portions 18 and 20 respectively spaced substantially 24 inches apart and side edge portions 22 extending between the front and rear edge portions and spaced apart substantially the same distance.

The chair 16 comprises a back 24 hingedly connected to a seat 26 from which a foldable foot rest 28 extends. The chair is conventionally suspended or supported in the opening 14 by means such as pivotal brackets 29 for folding the chair back 24 and seat 26 into parallel relationship and coincident with the opening 14 as indicated in FIG. 3 or into transverse seating relationship as seen in FIGS. 1 and 2.

The top 12 and chair 16 are supported in either of two selected positions above the floor or support by a height adjustment arrangement 30. The arrangement 30 includes a pair of spaced apart parallel tubular front support legs 32 and a pair of spaced apart parallel tubular rear support legs 34 connected together by a tubular cross bar 36. The tubular cross bar 36 carries latch means 38 for engaging a U-shaped tubular lever or locking bar 40, when the legs 32 and 34 are in a selected angular position for placing the table top 12 in the feeding position in which top 12 is substantially 29 inches from the floor.

Front legs 32 each comprise an upper straight tubular section 42 and a tubular lower or bottom section 44. The upper sections 42 are pivotally connected along a common axis adjacent their upper ends to the lower surface of the table top 12 by a pivot pin conventionally secured at the vertical leg of a respective U-shaped bracket 46. Each bracket 46 is located adjacent a respective rear corner of the top 12 and intermediate the chair or seat perimeter and the rear edge 20 of the top 12 so that the legs extend diagonally forwardly and downwardly therefrom. The brackets 46 are spaced apart by a greater distance than the chair sides so that each is spaced intermediate the chair and a respective side edge portion 22 of the top to cradle the chair 16 therebetween.

The bottom tubular section 44 of leg 32 comprises an intermediate segment 48 spaced from the floor by an end segment 50 extending generally transverse to the floor and having means at one end for engagement with the floor. Segment 50 extends at about 130° to segment 48 and the other end of the intermediate segment 48 has a short segment 52 extending therefrom in substantially the opposite parallel direction to segment 50. The end segment 52 telescopingly engages or mates with the lower end of straight section 42. A plastic coupling ring 54 is provided on the end of segment 52 receiving section 42 for reinforcing and stabilizing the connection to section 42. Segment 52 is also provided with a hole or aperture for receiving a conventional spring biased pin carried by section 42 to secure the sections 42 and 44 in assembled relationship against axial movement.

Each leg 32 is also pivotally secured to a respective back leg 34 by means of a pivot pin 56 extending through a respective straight section 42 just above the juncture with section 44 and through a plastic thrust washer 58 located between the respective legs 32 and 34. The pin 56 extends into conventional threaded or securing washers held in the tubular cross bar 36.

The cross bar 36 serves to stabilize the legs 32 and 34 against sidewards movement and is provided with recesses at each end to receive a portion of the respective leg 34 so that the ends of bar 36 partially overlap the legs 34 and therefore rotate or pivot therewith.

Legs 34 are also each formed in several sections including a substantially straight upper tubular section 60 having a bent upper end 62 and a lower or bottom tubular section 64. Section 64 is similar to section 44 in that section 64 includes an intermediate segment 66 from which end segments 68 and 70 project in substantially opposite parallel directions. Segment 68 extends generally downwardly and somewhat rearwardly and receives a caster 72 for rolling engagement with the floor while spacing the intermediate segment 66 from the floor. Segment 70 carries a plastic coupling ring 54 and has an aperture for receiving a spring biased pin in section 60 to secure one end of straight section 60.

A second pivot 74 is provided for sections 60 intermediate the bent upper end 62 and the pivot pin 56 for pivotally connecting the legs 34 along a common axis to a respective side leg 76 of the U-shaped lever bar 40. A plastic thrust washer 78 is located between each leg 34 and the respective lever bar leg 76.

The side legs 76 of the lever bar 40 are also each pivotally secured along a common axis to the lower surface of top 12 adjacent their ends by means of a respective pivot pin secured at the vertical leg of a U-shaped bracket 80 best seen in FIG. 3. Each bracket 80 and the associated pivot pins are located adjacent a respective front corner of the top 12 and intermediate the perimeter or boundary of the chair or seat and the side edge portions 22 so that the brackets 80 are spaced apart by a greater distance than the width of the chair. The center of gravity of the table, chair and baby are thus located intermediate the legs for distributing the forces therebetween along the longitudinal axis of each leg.

It will also be noted that the vertical legs of brackets 80 are located inwardly of the legs 34 and that legs 34 spaced substantially 21½ inches apart are located intermediate legs 76 and 32 with the vertical legs of brackets 46 located just outwardly of legs 32 to enable the legs to be located in close proimity to each other.

Figure 8:
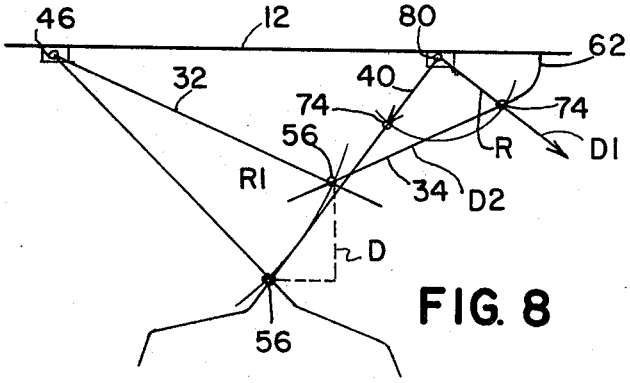
FIG. 8 is a diagramatic view illustrating the rotational position of the legs for supporting the table top at respective heights.

The legs 76 of lever bar 40 thus pivotally connect the legs 34 to the table top 12 and the back leg 82 of the lever bar, which may be most conveniently grasped, when the table is in the lowest or play position, serves to pivot the bar for controlling the angular relationship between the legs 32 and 34. When the side legs 76 of bar 40 are pivoted clockwise from the play position as seen in FIG. 8 along a radius R the pivot pin 56, which moves about a radius R1 extending from bracket 46, is translated downwardly and toward the central vertical axis of the table while pivot 74 moves in the same direction to reduce the angle between legs 32 and 34. Since the pivot pin 56 cannot actually move downwardly due to the floor resistance, the table top moves upwardly by a distance D to accommodate the reduced angle between legs 32 and 34. It will be noted that the distance D1 from brackets 80 to back leg 82 of lever arm 40 is considerably longer than radius R to provide a sufficient leverage against the weight of the table and baby for easily moving the top. On the other hand pivoting the lever bar in a counter clockwise direction as seen in FIG. 8 moves the pivots 56 and 74 toward the front of the table and the pivot pin 56 moves upwardly by a distance D as the angle between the legs 32 and 34 increases to thus lower the table toward the play position. The pivot 74 also starts to move upwardly, and when the end 62 on leg 34 engages the table top 12, further upward movement of pivot 74 stops to terminate any further increase in the angle between legs 32 and 34 and hold the table in the play position in which the top is substantially 22 inches above the floor. It will be also noted that the distance D2 between pivots 56 and 74 is fixed and larger than radius R to limit the travel of pivot 56 in the counter clockwise direction.

Figure 7:
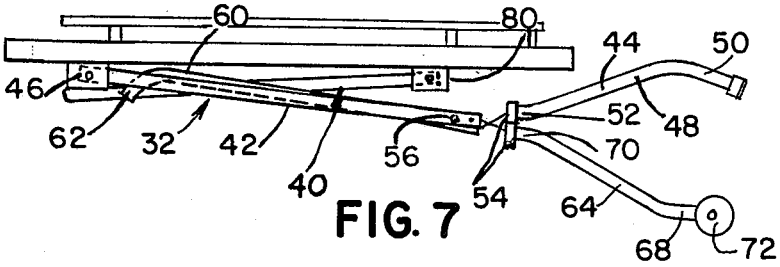
FIG. 7 is a side elevational view illustrating the table shown in FIGS. 1–6 with the legs in exploded and folded relationship to illustrate the table arranged for shipping condition.

As may be seen from FIGS. 3 and 7 the legs 32 and 34 together with bar 76 are foldable in a generally parallel relationship against the bottom surface of table top 12 by simply pivoting bar 40 clockwise past the feeding position. With the lower sections 44 and 64 disengaged from the respective mating sections 42 and 60 of legs 32 and 34 by depression of the respective spring biased pin and axial separation of the leg sections, the sections 42 and 60 fold within the perimeter of the table top for facile packing and shipping.

The consumer or purchaser may then assemble the lower sections 44 and 64, which are contained in the package, to the respective upper leg section 42 and 60 by insertion of one section in the other, after depressing the spring biased pin, until the pin snaps into the hole in sections 44 and 64. The table may thereafter be conveniently stored in the position as shown in FIG. 3.

To place the table 10 in use, the back leg 82 of the bar 40 is simply pivoted from the lower surface of the top while the top is allowed to pivot into a generally horizontal position on the pivot connections to legs 32. The weight of the table top will then normally increase the angular separation of legs 32 and 34. If the feeding position is desired, the lever bar 40 is allowed to rotate until the lever bar legs 76 are brought into a generally parallel relationship to legs 34 at which time the back leg 82 of the bar 40 is adjacent the cross bar 36. The latch means 38 on bar 36 which comprises a U-shaped wire or rod having one end leg pivotally secured to bar 36 is pivoted upwardly to engage its other end leg over the back leg 82 of the lever bar 40. This prevents further rotation of bar 40, while the table is held in the feeding position. The top 12 is then at its highest horizontal position and the legs form an X-shaped frame which is prevented from opening further to the play position by the latch 38. This height is substantially 29 inches.

The table 10 may of course be easily moved by simply raising the front legs 32 slightly from the floor and applying a force in the direction of desired movement to roll the table 10 on the casters 72 in the desired direction.

To place the table 10 in the play position the latch 38 is disengaged from the back leg 82 of the lever bar 40 by springing the same slightly or pivoting the lever bar backwardly therefrom. The lever bar 40 may then pivot forwardly as seen in FIG. 2 under the weight of the table to increase the angular separation of legs 32 and 34. The bent end 62 of leg 34 then moves into engagement with the lower surface of top 12 as the pivot 74 starts to move upwardly when legs 76 and 32 assume generally parallel positions to prevent further movement of pivots 56 and 74 in a forward direction, and hold the table in the play position. This table top is then substantially 22 inches high.

Table 10 is placed in the feeding position from the play position by grasping the easily accessible lever bar, which projects forwardly of the front edge, as seen in FIG. 2, and pivoting the same toward the table rear while the front edge of the table is raided slightly to accommodate movement of the bent end 62. When the side legs 76 of the bar 40 are parallel to legs 34, the latch 38 is operated as previously explained to hold the table in the feeding position. The table cannot roll since the ends of legs 32 are in frictional engagement with the floor. This is an additional safety feature.

It will be noted that each of the pivot connections to the table are located so that the forces applied by the baby's weight or movement are located within a boundary line joining the pivot positions and that these forces are thus directed substantially equally to the legs and pivots and that since the legs extend primarily in a vertical direction the forces are transmitted along the rigid vertical axis of the tubular legs.

The foregoing constitutes a description of one embodiment of a baby feeding table whose inventive concepts are believed set forth in the accompany claims.

What is claimed is:

1. A height adjustment arrangement for supporting on a floor a baby feeding table including a table top carrying a seat foldable between a closed position and an open position suspended from an opening in said top and spaced from the perimeter of said table top, the improvement comprising:

a first pair of parallel legs having spaced ends, first pivot means for each leg pivotally connecting along a common axis the respective leg adjacent one end of each leg with said table top at a respective spaced position located intermediate said seat and said perimiter for rotation about a common axis, another pair of parallel legs having spaced ends, first and second intermediate pivot means pivotally connecting a respective one leg of said other pair with a respective leg of said first pair at a position intermediate the ends of each connected leg, a tubular cross bar extending past opposite edge portions of said seat and between said first and said second intermediate pivot means, first and second securing means held in said cross bar adjacent a respective end of the cross bar for securing the first and second intermediate pivot means independently to said cross bar at respective positions spaced apart by a distance greater than the distance between opposite edge portions of said seat, a U-shaped lever bar pivotally connected with each leg of said other pair along a common axis spaced from said intermediate pivot means and from the ends of said lever bar, last pivot means pivotally connecting said lever bar with said table top along a common axis at a position intermediate said seat and the perimiter of said table top and spaced from the first pivot means, and locking means for locking said first pair of legs against pivotal movement relative said other pair of legs in each of two angular positions of said first pair of legs relative said other pair of legs.

2. The improvement claimed in claim 1 in which each leg has an intermediate portion extending in spaced substantially parallel relationship to said floor and a free end extending from said intermediate portion transversly to said floor in each of said angular positions to transmit forces between said table top and floor along the axis of each leg, and a caster secured solely to the free end of each of said other legs for engagement with said floor.

3. The improvement claimed in claim 1 in which said first pivot means and said last pivot means are spaced from each other by a distance greater than the distance between respective edges of said seat.

4. The improvement claimed in claim 2 in which said cross bar has ends in overlapping engagement with said each leg of said selected pair of legs.

5. The improvement claimed in claim 4 in which said first and second intermediate pivot means each includes a thrust washer between each leg of one pair and a respective leg of the other pair.

6. The improvement claimed in claim 5 in which said locking means includes a latch pivotally carried by one of said bars and having a leg for overlappingly engaging the other of said bars in one of said angular positions of said legs.

7. The improvement claimed in claim 1 in which said locking means includes a bent end portion on a leg of said other pair for engaging said table.

8. The improvement claimed in claim 1 in which said first pivot means is spaced outwardly of the pivot connection between said lever bar and said table top.

9. The improvement claimed in claim 1 in which the distance between said first pivot means and each of said intermediate pivot means is greater than the distance between said last pivot means and the pivot connection of said lever bar to each leg of said other pair of legs.

10. The improvement claimed in claim 9 in which said lever bar is U-shaped and the back leg is spaced from said last pivot means a greater distance than the distance between said last pivot means and the pivot connection of said lever bar to each leg of said other pair.

11. The improvement claimed in 2 in which each leg comprises a pair of sections with one section of each leg having a straight configuration and receiving each pivot connection for the respective leg, and the other section of each leg includes said intermediate portion and said free end portion, and a spring biased pin securing each intermediate portion to a respective one section.

* * * * *